US010317810B2

(12) United States Patent
Luo et al.

(10) Patent No.: US 10,317,810 B2
(45) **Date of Patent: *Jun. 11, 2019**

(54) ORGANIC PHOTOCONDUCTOR DRUM HAVING AN OVERCOAT CONTAINING NANO METAL OXIDE PARTICLES AND METHOD TO MAKE THE SAME

(71) Applicant: LEXMARK INTERNATIONAL, INC., LEXINGTON, KY (US)

(72) Inventors: Weimei Luo, Louisville, CO (US); Mark Thomas Bellino, Loveland, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/802,722

(22) Filed: Nov. 3, 2017

(65) Prior Publication Data

US 2019/0137897 A1 May 9, 2019

(51) Int. Cl.

| | |
|---|---|
| ***G03G 5/00*** | (2006.01) |
| ***G03G 5/05*** | (2006.01) |
| ***G03G 5/147*** | (2006.01) |
| ***G03G 5/10*** | (2006.01) |
| ***G03G 5/06*** | (2006.01) |

(52) U.S. Cl.

CPC ..... *G03G 5/0525* (2013.01); *G03G 5/0592* (2013.01); *G03G 5/06* (2013.01); *G03G 5/102* (2013.01); *G03G 5/147* (2013.01); *G03G 5/14704* (2013.01); *G03G 5/14708* (2013.01); *G03G 5/14713* (2013.01); *G03G 5/14769* (2013.01)

(58) Field of Classification Search

CPC ..... G03G 5/147; G03G 5/14704; G03G 5/14713; G03G 5/14769

See application file for complete search history.

(56) References Cited

U.S. PATENT DOCUMENTS

| | | | | |
|---|---|---|---|---|
| 9,513,591 | B2 * | 12/2016 | Black | G03G 5/0575 |
| 2009/0246665 | A1 * | 10/2009 | Wu | G03G 5/0546 430/66 |
| 2015/0111150 | A1 | 4/2015 | Reeves et al. | |
| 2015/0168908 | A1 * | 6/2015 | Black | G03G 5/0575 430/56 |
| 2015/0192869 | A1 | 7/2015 | Takezawa | |
| 2016/0085162 | A1 | 3/2016 | Black et al. | |

FOREIGN PATENT DOCUMENTS

| | | |
|---|---|---|
| JP | 2012128324 | 7/2012 |

OTHER PUBLICATIONS

Final Office Action dated Apr. 4, 2018 for U.S. Appl. No. 15/802,704 (Luo).

United States Patent and Trademark Office Final Office Action dated Nov. 21, 2018 for U.S. Appl. No. 15/802,704.

* cited by examiner

*Primary Examiner* — Mark A Chapman

(57) ABSTRACT

An improved organic photoconductor drum having a protective overcoat layer and method to make the same is provided. The protective overcoat layer is prepared from a curable composition including nano metal oxide particles sized less than 400 nm in combination with an urethane acrylate resin having at least 6 functional groups.

11 Claims, 3 Drawing Sheets

ORGANIC PHOTOCONDUCTOR DRUM HAVING AN OVERCOAT CONTAINING NANO METAL OXIDE PARTICLES AND METHOD TO MAKE THE SAME

CROSS REFERENCES TO RELATED APPLICATIONS

None.

BACKGROUND

1. Field of the Disclosure

The present disclosure relates generally to electrophotographic image forming devices, and more particularly to an organic photoconductor drum having an overcoat containing nano metal oxide particles, in particular indium tin oxide, and method to make the same.

2. Description of the Related Art

Organic photoconductor drums have generally replaced inorganic photoconductor drums in electrophotographic image forming device including copiers, facsimiles and laser printers due to their superior performance and numerous advantages compared to inorganic photoconductors. These advantages include improved optical properties such as having a wide range of light absorbing wavelengths, improved electrical properties such as having high sensitivity and stable chargeability, availability of materials, good manufacturability, low cost, and low toxicity.

While the above enumerated performance and advantages exhibited by an organic photoconductor drums are significant, inorganic photoconductor drums traditionally exhibit much higher durability—thereby resulting in a photoconductor having a desirable longer life. Inorganic photoconductor drums (e.g., amorphous silicon photoconductor drums) are ceramic-based, thus are extremely hard and abrasion resistant. Conversely, the surface of an organic photoconductor drums is typically comprised of a low molecular weight charge transport material and an inert polymeric binder and are susceptible to scratches and abrasions. Therefore, the drawback of using organic photoconductor drums typically arises from mechanical abrasion of the surface layer of the photoconductor drum due to repeated use. Abrasion of photoconductor drum surface may arise from its interaction with print media (e.g. paper), paper dust, or other components of the electrophotographic image forming device such as the cleaner blade or charge roll.

The abrasion of photoconductor drum surface degrades its electrical properties, such as sensitivity and charging properties. Electrical degradation results in poor image quality, such as lower optical density, and background fouling. When a photoconductor drum is locally abraded, images often have black toner bands due to the inability to hold charge in the thinner regions. This black banding on the print media often marks the end of the life of the photoconductor drum, thereby causing the owner of the printer with no choice but to purchase another expensive photoconductor drum, or a new image unit, or in some cases, the whole cartridge altogether.

Increasing the life of the photoconductor drum will allow the photoconductor drum to become a permanent part of the electrophotographic image forming device. The photoconductor drum will no longer be a replaceable unit nor be viewed as a consumable item that has to be purchased multiple times by the owner of the electrophotographic printer. Photoconductor drums having a long life allow the printer to operate with a lower cost-per-page, more stable image quality, and less waste leading to a greater customer satisfaction with his or her printing experience.

To achieve a long life photoconductor drum, especially with organic photoconductor drum, a protective overcoat layer may be coated onto the surface of the photoconductor drum. The protective overcoat may be polymeric and/or crosslinkable. However, many overcoat layers do not have the robustness for edge wear of photoconductor drums used in direct-to-paper printing applications.

Another drawback of these overcoats is that they significantly alter the electrophotographic properties of the photoconductor drum in a negative way. If the overcoat layer is too electrically insulating, the photoconductor drum will not discharge and will result in a poor latent image. On the other hand, if the overcoat layer is too electrically conducting, then the electrostatic latent image will spread resulting in a blurred image. Thus, a protective overcoat layer that extends the life of the photoconductor drum must not negatively alter the electrophotographic properties of the photoconductor drum, thereby allowing sufficient charge migration through the overcoat layer to the photoconductor surface for adequate development of the latent image with toner.

Many protective overcoat formulations include cross-linkable charge transport materials. Photoconductors having a protective layer with no cross-linkable charge transport materials show image defects and higher wear rates when compared to photoconductors having an overcoat with these cross-linkable charge transport materials. However, there are some drawbacks to including charge transport materials into a protective overcoat. Multiple synthesis steps and lengthy purification processes are involved in preparing these cross linkable charge transport materials. Therefore the cost to manufacture charge transport materials is extremely high, ultimately increasing the price of the photoconductor.

SUMMARY

The present disclosure provides an organic photoconductor drum having a protective overcoat containing nano metal oxide particles and method to make the same. The organic photoconductor drum is used in an organic photoconductor drum of an electrophotographic image forming device. The organic photoconductor contains an electroconductive support, a charge generation layer deposited over the support, a charge transport layer deposited over the charge generation layer, and a cross linked overcoat deposited over the charge transport layer. The overcoat layer is prepared from a curable composition including nano metal oxide particles and an urethane resin having at least six radical polymerizable functional groups having no charge transport structure. Another embodiment of the overcoat layer is prepared from a curable composition including nano metal oxide particles and an oligomer having no charge transport structure. A useful nano metal oxide particle is indium tin oxide ("ITO"). Other nano metal oxide particles may include aluminum oxide, zirconium oxide, zinc oxide, indium oxide lanthanum oxide, antimony tin oxide or a combination of two or more. The overcoat formulation does not include charge transport materials. Surprisingly, the resulting cured overcoated organic photoconductor drum shows excellent abrasion resistance and electrical stability without the use of costly cross-linkable charge transport materials. The amount of the nano metal oxide particles in the curable overcoat composition is about 5 percent to about 30 percent by weight. The amount of the urethane resin having at least six radical polymerizable functional groups in the curable overcoat composition is about 70 percent to about 95 percent by weight. Curing of the overcoat formulation creates a three-dimensional crosslinked structure with a high degree of optical transparency and excellent abrasion resistance. The overcoat is free of cracks or other defects arising from internal stress. This overcoat layer incorporating nano meal oxide particles improves the wear resistance of the organic photoconductor drum while simultaneously having excellent electrical properties.

The method to make the organic photoconductor drum having an overcoat containing nano metal oxide particles is generally outlined as follows. An electrically conductive substrate is provided. A charge generation layer dispersion is prepared then coated over the electrically conductive substrate to form a charge generation layer. A charge transport layer dispersion is prepared then coated over the charge generation layer to form a charge transport layer. An overcoat layer formulation including about 70 percent to about 95 percent by weight of a urethane acrylate resin having at least six radical polymerizable functional groups and about 5 percent to about 30 percent by weight of a nano metal oxide particle sized $D_{90}$<400 nm is prepared and coated over the charge transport layer. The overcoat layer formulation is then cured to form the photoconductor.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

Figure 1:
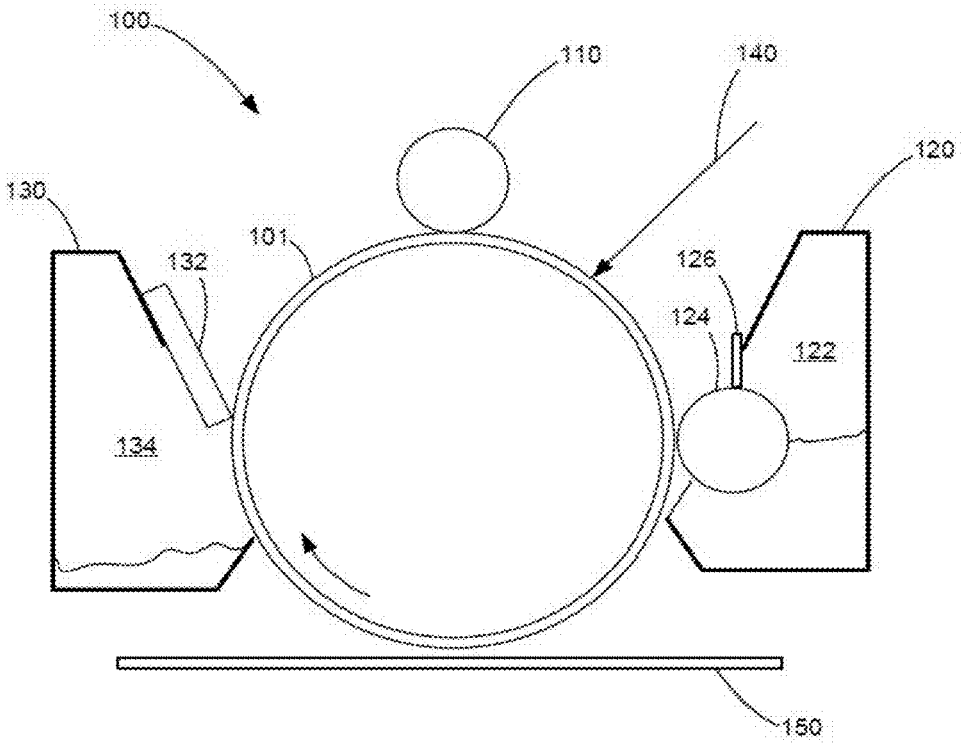
FIG. 1 is a schematic view of an electrophotographic image forming device.

It is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

FIG. 1 illustrates a schematic representation of an example electrophotographic image forming device 100. Image forming device 100 includes a photoconductor drum 101, a charge roll 110, a developer unit 120, and a cleaner unit 130. The electrophotographic printing process is well known in the art and, therefore, is described briefly herein. During a print operation, charge roll 110 charges the surface of photoconductor drum 101. The charged surface of photoconductor drum 101 is then selectively exposed to a laser light source 140 to form an electrostatic latent image on photoconductor drum 101 corresponding to the image being printed. Charged toner from developer unit 120 is picked up by the latent image on photoconductor drum 101 creating a toned image.

Developer unit 120 includes a toner sump 122 having toner particles stored therein and a developer roll 124 that supplies toner from toner sump 122 to photoconductor drum 101. Developer roll 124 is electrically charged and electrostatically attracts the toner particles from toner sump 122. A doctor blade 126 disposed along developer roll 124 provides a substantially uniform layer of toner on developer roll 124 for subsequent transfer to photoconductor drum 101. As developer roll 124 and photoconductor drum 101 rotate, toner particles are electrostatically transferred from developer roll 124 to the latent image on photoconductor drum 101 forming a toned image on the surface of photoconductor drum 101. In one embodiment, developer roll 124 and photoconductor drum 101 rotate in the same rotational direction such that their adjacent surfaces move in opposite directions to facilitate the transfer of toner from developer roll 124 to photoconductor drum 101. A toner adder roll (not shown) may also be provided to supply toner from toner sump 122 to developer roll 124. Further, one or more agitators (not shown) may be provided in toner sump 122 to distribute the toner therein and to break up any clumped toner.

The toned image is then transferred from photoconductor drum 101 to print media 150 (e.g., paper) either directly by photoconductor drum 101 or indirectly by an intermediate transfer member. A fusing unit (not shown) fuses the toner to print media 150. A cleaning blade 132 (or cleaning roll) of cleaner unit 130 removes any residual toner adhering to photoconductor drum 101 after the toner is transferred to print media 150. Waste toner from cleaning blade 132 is held in a waste toner sump 134 in cleaning unit 130. The cleaned surface of photoconductor drum 101 is then ready to be charged again and exposed to laser light source 140 to continue the printing cycle.

The components of image forming device 100 are replaceable as desired. For example, in one embodiment, developer unit 120 is housed in a replaceable unit with photoconductor drum 101, cleaner unit 130 and the main toner supply of image forming device 100. In another embodiment, developer unit 120 is provided with photoconductor drum 101 and cleaner unit 130 in a first replaceable unit while the main toner supply of image forming device 100 is housed in a second replaceable unit. In another embodiment, developer unit 120 is provided with the main toner supply of image forming device 100 in a first replaceable unit and photoconductor drum 101 and cleaner unit 130 are provided in a second replaceable unit. Further, any other combination of replaceable units may be used as desired. In some example embodiment, the photoconductor drum 101 may not be replaced and is a permanent component of the image forming device 100.

Figure 2:
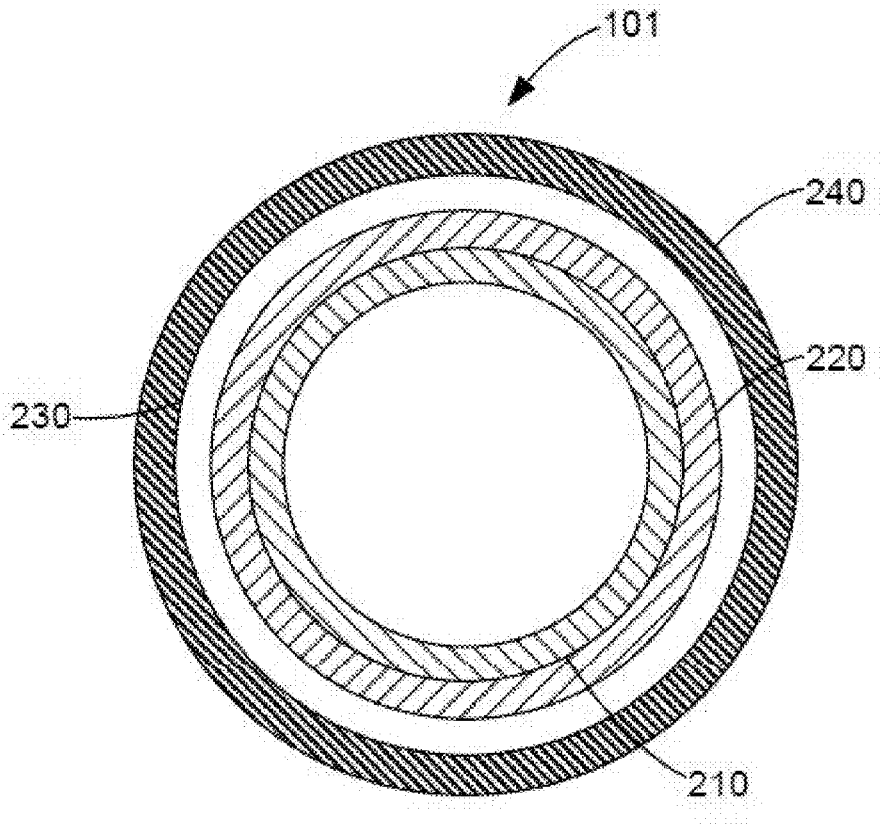
FIG. 2 is a cross-sectional view of a photoconductor drum of the electrophotographic image forming device.

FIG. 2 illustrates an example photoconductor drum 101 in more detail. In this example embodiment, the photoconductor drum 101 is an organic photoconductor drum and includes a support element 210, a charge generation layer 220 disposed over the support element 210, a charge transport layer 230 disposed over the charge generation layer 220, and a protective overcoat layer 240 formed as an outermost layer of the photoconductor drum 101. Additional layers may be included between the support element 210, the charge generation layer 220 and the charge transport layer 230, including adhesive and/or coating layers.

The support element 210 as illustrated in FIG. 2 is generally cylindrical. However the support element 210 may assume other shapes or may be formed into a belt. In one example embodiment, the support element 210 may be formed from a conductive material, such as aluminum, iron, copper, gold, silver, etc. as well as alloys thereof. The surfaces of the support element 210 may be treated, such as by anodizing and/or sealing. In some example embodiment, the support element 210 may be formed from a polymeric material and coated with a conductive coating.

The charge generation layer 220 is designed for the photogeneration of charge carriers. The charge generation layer 220 may include a binder and a charge generation compound. The charge generation compound may be understood as any compound that may generate a charge carrier in response to light. In one example embodiment, the charge generation compound may comprise a pigment being dispersed evenly in one or more types of binders.

The charge transport layer 230 is designed to transport the generated charges. The charge transport layer 230 may include a binder and a charge transport compound. The charge transport compound may be understood as any compound that may contribute to surface charge retention in the dark and to charge transport under light exposure. In one example embodiment, the charge transport compounds may include organic materials capable of accepting and transporting charges.

In an embodiment, the charge generation layer 220 and the charge transport layer 230 are configured to combine in a single layer. In such configuration, the charge generation compound and charge transport compound are mixed in a single layer. In another embodiment the charge generation layer is 220 and charge transport layer is 230 are configured in two separate layers wherein the charge transport layer is 230 is disposed over the charge generation layer 220.

The overcoat layer 240 is designed to protect the photoconductor drum 101 from wear and abrasion without altering the electrophotographic properties, thus extending the service life of the photoconductor drum 101. The overcoat layer 240 has a thickness of about 0.1 μm to about 10 μm. Specifically, the overcoat layer 240 has a thickness of about 1 μm to about 6 μm, and more specifically a thickness of about 1-2 μm. The thickness of the overcoat layer 240 is kept at a range that will not provide adverse effect to the electrophotographic properties of the photoconductor drum 101.

To form the organic photoconductor drum, an electrically conductive cylindrical substrate is provided. Usually the substrate is made of aluminum. A charge generation dispersion is made then coated over the electrically conductive cylindrical substrate and dried or cured at a temperature between about 50° C. and about 150° C. for a period ranging between about 10 minutes to about 30 minutes to form a charge generation layer over the electrically conductive cylindrical substrate. A charge transport dispersion is prepared and coated on top of the formed charge generation layer and cured at a temperature between about 75° C. and about 180° C. for a period ranging between about 30 minutes to about 90 minutes to form a charge transport layer over the charge generation layer. An overcoat formulation is prepared and then coated over the formed charge transport layer. The overcoated organic photoconductor drum is cured by exposure to either an electron beam or ultraviolet light, then subject to a thermal cure at a temperature between about 75° C. and about 180° C. for a period ranging between about 30 minutes to about 90 minutes. The cured overcoat has a thickness of less than 2.0 μm.

In an example embodiment, the overcoat layer 240 includes a three-dimensional crosslinked structure formed from a curable composition. The curable composition includes a composition including nano metal oxide particles and a urethane resin having at least six radical polymerizable functional groups. The curable composition includes about 70 percent to about 95 percent by weight of the urethane resin having at least six crosslinkable functional groups, and about 5 percent to about 30 percent by weight of the nano metal oxide particles. The overcoat does not have any component having charge transporting materials. In an example embodiment, the curable composition includes 85 percent by weight of the urethane resin having at least six radical polymerizable functional groups, and 15 percent by weight of the nano metal oxide particles. Usable nano metal oxide particles are sized less than 400 nm. Nano metal oxides can be aluminum oxide, zirconium oxide, zinc oxide, indium oxide, lanthanum oxide, antimony tin oxide or a combination of two or more. A useful nano metal oxide particle is indium tin oxide sized 30 nm to 300 nm. An acceptable indium tin oxide particle is sized less than 200 nm and sold by Evonik under the tradename VP Disp. ITO TC8 DE X.

The at least six radical polymerizable functional groups of the urethane resin may be the same or different, and may be selected from the group consisting of acrylate, methacrylate, styrenic, allylic, vinylic, glycidyl ether, epoxy, or combinations thereof. A particularly useful urethane resin having at least six radical polymerizable functional groups includes a hexa-functional aromatic urethane acrylate resin, a hexa-functional aliphatic urethane acrylate resin, or combinations thereof.

In an example embodiment, the hexa-functional aromatic urethane acrylate resin has the following structure:

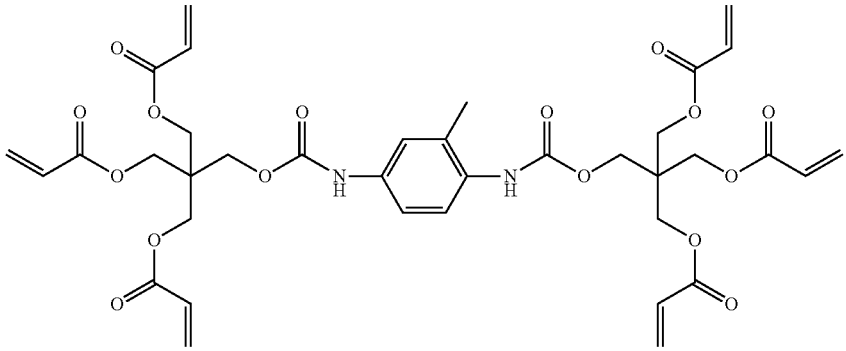

and is commercially available under the trade name CN975 manufactured by Sartomer Corporation, Exton, Pa.

In an example embodiment, the hexa-functional aliphatic urethane acrylate resin has the following structure:

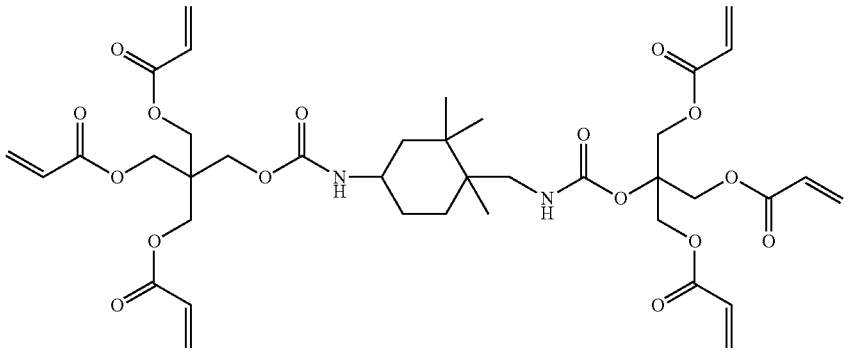

and is commercially available under the trade name EBECRYL® 8301 manufactured by Cytec Industries, Woodland Park, N.J.

The present invention describes a photoconductor overcoat layer comprising the unique combination of a urethane acrylate resin having at least six functional groups and nano metal oxide particles, in particular indium tin oxide. This combination surprisingly provides higher wear rates and no image defects in spite of having no costly charge transporting materials in the overcoat formulation. Additionally, the overcoat of the present invention has (1) excellent adhesion to the photoconductor surface, (2) optical transparency and (3) provides a photoconductor drum that is resistant to cracking and crazing. Moreover this overcoat is cost effective to make because it does not incorporate costly charge transporting materials.

The curable composition may further include a monomer or oligomer having at most five radical polymerizable functional groups. The at most five radical polymerizable functional groups of the monomer or oligomer may be selected from the group consisting of acrylate, methacrylate, styrenic, allylic, vinylic, glycidyl ether, epoxy, or combinations thereof.

Suitable examples of mono-functional monomers or oligomers include, but are not limited to, methyl acrylate, methyl methacrylate, ethyl acrylate, ethyl methacrylate, propyl acrylate, propyl methacrylate, isobornyl acrylate, isobornyl methacrylate, 2-phenoxyethyl acrylate, and lauryl methacrylate.

Suitable examples of di-functional monomers or oligomers includes, but are not limited to, diacrylates and dimethacrylates, comprising 1,4-butanediol diacrylate, 1,4-butanediol dimethacrylate, ethylene glycol dimethacrylate, diethylene glycol diacrylate, diethylene glycol dimethacrylate, triethylene glycol diacrylate, triethylene glycol dimethacrylate, 1,3-butylene glycol diacrylate, 1,6-hexanediol diacrylate, 1,6-hexanediol dimethacrylate, 1,12-dodecanediol methacrylate, tripropylene glycol diacrylate, 1,3-butylene glycol dimethacrylate, 1,3-butylene glycol dimethacrylate, cyclohexane dimethanol diacrylate esters, or cyclohexane dimethanol dimethacrylate esters.

Suitable examples of tri-functional monomers or oligomers include, but are not limited to, trimethylolpropane triacrylate, trimethylolpropane trimethacrylate, hydroxypropyl acrylate-modified trimethylolpropane triacrylate, ethylene oxide-modified trimethylolpropane triacrylate, propylene oxide-modified trimethylolpropane triacrylate, and caprolactone-modified trimethylolpropane triacrylate.

Suitable examples tetrafunctional monomers or oligomers include, but are not limited to, pentaerythritol tetraacrylate, ethoxylated pentaerythritol tetraacrylate, and di(trimethylolpropane) tetraacrylate.

Suitable examples pentafunctional monomer or oligomer include, but are not limited to, pentaacrylate esters, dipentaerythritol pentaacrylate esters, and melamine pentaacrylates.

The curable composition may further consist of an additive including a coating aid such as a surfactant at an amount equal to or less than about 10 percent by weight of the curable composition. More specifically, the amount of additive is about 0.1 to about 5 percent by weight of the curable composition. The additive may improve coating uniformity of the curable composition or modify the coating surface. The additive can be crosslinkable (reactive) or non-crosslinkable.

The curable composition is prepared by mixing the nano metal oxide particles and urethane resin or oligomer in a solvent. The solvent may include organic solvent. The curable composition may be coated on the outermost surface of the photoconductor drum 101 through dipping or spraying. If the curable composition is applied through dip coating, an alcohol is used as the solvent to minimize dissolution of the components of the charge transport layer 230. The alcohol solvent includes isopropanol, methanol, ethanol, butanol, or combinations thereof. In an example embodiment, the solvent is ethanol.

The coated curable composition is exposed to an electron beam or ultraviolet light of sufficient energy to induce formation of free radicals to initiate the crosslinking. The exposed composition is then subjected to thermal cure to remove solvent, anneal and relieve stresses in the coating.

Preparation of Example Base Photoconductor

Example Base Photoconductor does not have a protective overcoat layer. Photoconductor drums were formed using an aluminum substrate, a charge generation layer coated onto the aluminum substrate, and a charge transport layer coated on top of the charge generation layer.

The charge generation layer was prepared from a dispersion including type IV titanyl phthalocyanine, polyvinylbutyral, poly(methyl-phenyl)siloxane and polyhydroxystyrene at a weight ratio of 45:27.5:24.75:2.75 in a mixture of 2-butanone and cyclohexanone solvents. The polyvinylbutyral is available under the trade name BX-1 by Sekisui Chemical Co., Ltd. The charge generation dispersion was coated onto the aluminum substrate through dip coating and dried at 100° C. for 15 minutes to form the charge generation layer having a thickness of less than 1 μm, specifically a thickness of about 0.2 μm to about 0.3 μm.

The charge transport layer was prepared from a formulation including terphenyl diamine derivatives (450 g) and polycarbonate Z300 (550 g) in a mixed solvent of THF and 1,4-dioxane. The charge transport formulation was coated on top of the charge generation layer and cured at 120° C. for 1 hour to form the charge transport layer having a thickness of about 26μm as measured by an eddy current tester.

Preparation of Example Photoconductor 1

Example Photoconductor 1 is overcoated with an overcoat layer having nano metal oxide particles and a urethane resin having at least 6 functional groups and no charge transport material. The overcoat layer was prepared from a formulation including indium tin oxide (ITO) (25 grams of ITO dispersion, 30% solid) and EBECRYL® 8301 (41.8 grams) in 15% concentration (by weight) in ethanol. The formulation was coated through dip coating on the outer surface of the Example Base Photoconductor. The coated layer was subjected to an electron beam cure at 86 kGy, and then thermally cured at 120° C. for 60 minutes. The cured cross-linked layer forms the overcoat layer having a thickness of about 1.5 μm as measured by an eddy current tester. The overcoat thickness may be adjusted by either varying the amount of solvent, or changing the coat speed.

Preparation of Example Comparative Photoconductor 1

Example Comparative Photoconductor 1 is overcoated with a layer having charge transport materials and no nano metal oxide particles. The overcoat layer formulation was prepared from a formulation including EBECRYL® 8301 (23.3 g) and crosslinkable charge transport molecules having the following formula:

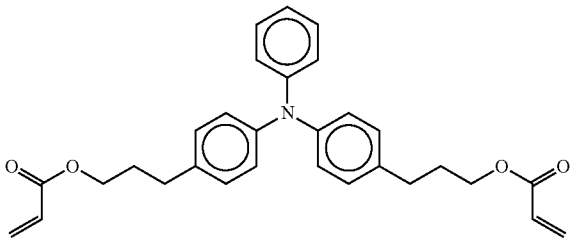

The weight ratio of the cross-linkable charge transport molecules to the EBECRYL® 8301 was 30:70. The formulation was coated through dip coating on the outer surface of the Example Base Photoconductor. The coated layer was subjected to an electron beam cure at 86 kGy, then thermally cured at 120° C. for 60 minutes. The cured cross-linked layer forms the overcoat having a thickness of about 1.5 μm as measured by an eddy current tester. The overcoat thickness may be adjusted by either varying the amount of solvent, or changing the coat speed.

Preparation of Example Comparative Photoconductor 2

Example Comparative Photoconductor 2 is overcoated with a layer having no nano metal oxide particles and no charge transport material. EBECRYL® 8301 (30 grams) was dissolved in ethanol. The weight ratio of EBECRYL® 8301 to ethanol was 30:70. The formulation was coated through dip coating on the outer surface of the Example Base Photoconductor. The coated layer was subjected to an electron beam cure at 86 kGy, and then thermally cured at 120° C. for 60 minutes. The cured cross-linked layer forms the overcoat layer having a thickness of about 1.5 μm. as measured by an eddy current tester. The overcoat thickness may be adjusted by either varying the amount of solvent or changing the coat speed.

The Example Photoconductor 1 and the Comparative Photoconductor 1 were installed in the electrophotographic image forming device Lexmark MS812dn. The electrophotographic image forming device was then operated at 70 ppm with run mode 4 page-and-pause, duplex. Wear rates, image print quality and discharge voltage for each of the installed photoconductor drums were then monitored. Results are presented in Table 1.

TABLE 1

| Photoconductor | Overcoat Layer Thickness (μm) | Discharge Voltage | Wear rate at OPC bottom paper edge (236-238 mm), (um/1M revs) | Image print Quality |
|---|---|---|---|---|
| Example 1 | 1.5 | −100 V | <1 um | Excellent |
| Comparative Example 1 | 1.5 | −120 V | <1 um | Excellent |
| Comparative Example 2 | 1.5 | Extremely High (>400 V) | n/a | Not a viable OPC |

Figure 3:
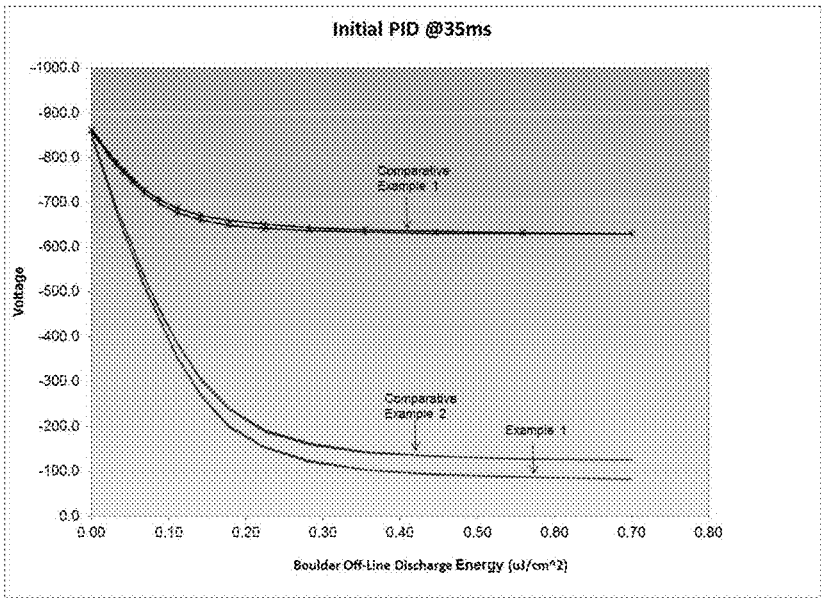
FIG. 3 is a graphical illustration comparing the photoinduced discharge of 3 different photoconductors.

As illustrated in Table 1 and FIG. 3, Example Photoconductor 1 overcoated with the formulation having nano metal oxide particles dispersed with a urethane resin and no costly charge transport materials has similar minimal wear, excellent electrical performance and excellent image print quality performance when compared to the Comparative Photoconductor 1 overcoated with the urethane resin and costly charge transport molecules. As shown in FIG. 3, Comparative Photoconductor 2 was not tested for wear and print quality due to extremely high photo induced discharge.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A method of preparing an organic photoconductor drum comprising:

providing an electrically conductive substrate;

preparing a charge generation layer dispersion:

coating the charge generation layer dispersion over the electrically conductive substrate to form a charge generation layer;

preparing a charge transport layer dispersion:

coating the charge transport layer dispersion over the charge generation layer to form a charge transport layer;

preparing an overcoat layer formulation including:

about 70 percent to about 95 percent by weight of a urethane acrylate resin having at least six radical polymerizable functional groups; and about 5 percent to about 30 percent by weight of a nano metal oxide particle sized less than 400 nm and selected from the group consisting of indium tin oxide, aluminum oxide, zirconium oxide, zinc oxide, indium oxidem, lanthanum oxide and antimony tin oxide;

an organic solvent;

coating the overcoat layer formulation over the charge transport layer; and curing the overcoat layer formulation to form a photoconductor having an overcoat layer over the charge transport layer and the charge generation layers, wherein the overcoat layer does not include charge transport materials.

2. The method of claim 1, wherein the urethane acrylate resin having at least six radical polymerizable functional groups is a hexa-functional aromatic urethane acrylate resin having the following structure:

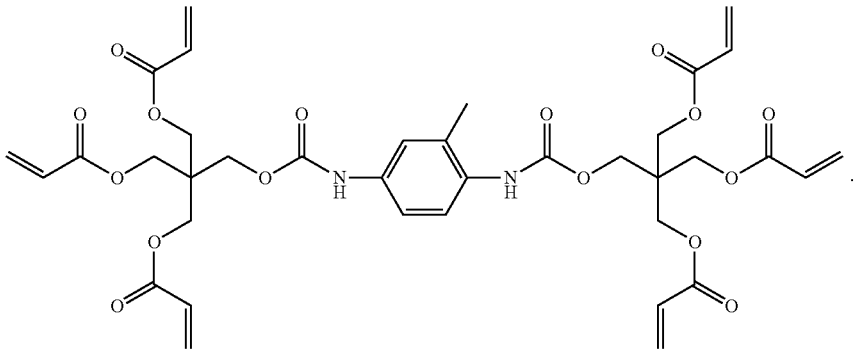

3. The method of claim 1, wherein the urethane resin having at least six radical polymerizable functional groups is a hexa-functional aliphatic urethane acrylate resin having the following structure:

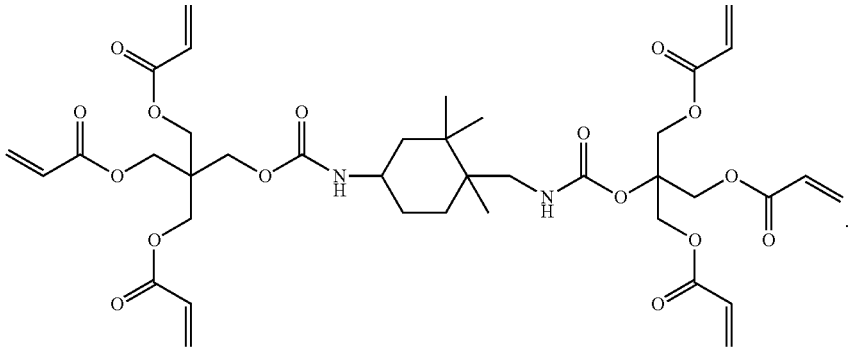

4. The method of claim 1, wherein the overcoat layer is cured by an electron beam.

5. The method of claim 4, wherein the cured overcoat layer has a thickness of about 0.1 μm to about 10 μm.

6. The method of claim 1, wherein the nano metal oxide particle is indium tin oxide.

7. The method of claim 6, wherein the indium tin oxide metal particle is sized less than 200 nm.

8. The method of claim 1, wherein the overcoat layer formulation further includes a monomer or oligomer having at most five radical polymerizable functional groups.

9. The method of claim 1, wherein the overcoat layer formulation further includes a coating aid additive at an amount equal to or less than about 10 percent by weight of the curable composition.

10. The method of claim 9, wherein the amount of the coating aid additive is about 0.1 to about 5 percent by weight of the curable composition.

11. The method of claim 9, wherein the coating aid additive is a surfactant.

* * * * *